US005543784A

United States Patent [19]

Mendenhall

[11] Patent Number: 5,543,784

[45] Date of Patent: Aug. 6, 1996

[54] OVEN OCCUPANCY WARNING APPARATUS

[76] Inventor: Donna M. Mendenhall, 212 W. Agnes Ave., Santa Maria, Calif. 93454

[21] Appl. No.: 159,318

[22] Filed: Nov. 30, 1993

[51] Int. Cl.[6] ..... G08B 13/14

[52] U.S. Cl. ..... 340/568; 99/342; 200/85 R; 250/222.1; 340/666

[58] Field of Search ..... 340/568, 666, 340/555–56; 250/222.1; 219/452, 518, 708, 720; 200/85 R; 177/45; 99/342, 344, 357

[56] References Cited

U.S. PATENT DOCUMENTS

| | | | |
|---|---|---|---|
| 2,142,599 | 1/1939 | Binder | 219/518 X |
| 2,147,024 | 2/1939 | Frisk | 340/686 |
| 2,693,142 | 11/1954 | Ireland | 200/85 R X |
| 2,879,708 | 3/1959 | Cripe | 99/342 |
| 3,330,203 | 7/1967 | Korr | 99/342 X |
| 3,689,909 | 9/1972 | Cotter | 200/85 R X |
| 3,990,074 | 11/1976 | Sondy | 432/32 |
| 4,117,461 | 9/1978 | Kiebala | 340/666 X |
| 4,446,455 | 5/1984 | Nashawaty | 340/568 |
| 4,577,181 | 3/1986 | Lipscher et al. | 340/666 X |
| 4,724,292 | 2/1988 | Ichikawa | 219/708 |
| 4,727,799 | 3/1988 | Ohshima et al. | 99/331 |
| 4,733,054 | 3/1988 | Paul | 219/518 X |
| 5,229,753 | 7/1993 | Berg et al. | 340/666 X |

FOREIGN PATENT DOCUMENTS

| | | | |
|---|---|---|---|
| 0148124 | 7/1985 | European Pat. Off. | 340/666 |

*Primary Examiner*—Thomas Mullen
*Attorney, Agent, or Firm*—Leo F. Costello

[57] ABSTRACT

An oven occupancy warning apparatus for domestic cooking ovens which senses the presence of an object within the oven and provides a warning of such presence. Except for the subject apparatus, the oven is of conventional construction and thus has a heating chamber and a food rack supported in the chamber. The apparatus supports the rack for slight pivoting or rocking movement about a horizontal axis in response to the presence of an object resting on the rack, regardless of where on the rack the object is located. An alarm activator associated with the rack is activated when the rack pivots in response to the presence of an object thereon, and an alarm is activated by the alarm activator to alert a user of the oven that an object is in the oven. The apparatus is useful with both gas and electrically heated ovens and is especially useful to alert a user of an object in the oven before preheating the oven, an action frequently taken without opening the oven.

15 Claims, 3 Drawing Sheets

OVEN OCCUPANCY WARNING APPARATUS

BACKGROUND OF THE INVENTION

1. Field of the Invention

The present invention relates to ovens found in the kitchen ranges in most homes. Specifically, it relates to a warning apparatus to notify the user that, prior to use, there is an object in the oven.

2. Description of the Prior Art

The physical capacity, the available wide range of temperatures, the choice of heating methods and the variety of food containers, cast iron, aluminum, pottery, ceramics, in various shapes and sizes, have combined to make the oven the useful cooking tool it is. The range is usually located in the kitchen, where is common for any member of a family to take advantage of the oven's utility. It is not unusual for item to be placed in unheated ovens for reasons not related to baking. Such items will normally be damaged or destroyed or could cause fires if the oven were preheated while the object was still present. There is a noteworthy and critical safety means lacking during the preheating phase of oven operation. It is common practice, reflected by instructions in every cookbook, that an oven is to be preheated to a specified temperature prior to placing a food item in the oven to be baked. Commonly a light on the oven control panel tells the user when the oven is heating but goes out when the selected temperature has been reached. Thus, an object may be in the hot oven but with no indication to the user, such as by means of the control panel, that the oven is occupied by the object. It is this primary phase of operating an oven that the present invention is addressed.

Therefore, it would be desirable to have an occupancy sensing system that would activate a warning device, such as a light, to indicate to the user that there is an object within the oven.

U.S. Pat. No. 4,724,292 to Ichikawa describes a weight measuring device, with digital display, for microwave ovens, which require no preheating.

Of particular interest is U.S. Pat. No. 4,446,455 to Nashawaty, which describes apparatus for indicating that a utensil, such as a pot or pan, has been placed on a stove top burner. The apparatus described is intended to promote energy conservation by activating an alarm if the burner is turned on but no utensil is present. The apparatus includes a vertical plunger which extends upwardly through the center of the burner and is connected to a normally closed electrical switch switch in the alarm circuit. When a utensil is placed on the burner, the plunger is depressed, opening the switch and deactivating the alarm circuit. Alternatively the burner may be depressed to open the circuit switch and resile slightly to close it.

The Nashawaty system has several deficiencies. It can be used only with electric stove top elements, and not gas, since the plunger cannot pass through a central gas supply burner without disrupting gas flow. It can only detect a utensil which is placed in a specific location, i.e., centered on a fixed burner. A utensil or other object placed at the side of a burner could still be damaged by heat, but would not be detected. This also means that there must be a plurality of detectors (one for each burner), which is expensive and requires substantial additional wiring within the stove. Nashawaty does not teach that the system described has any applicability to an oven as contrasted to a stove top. Those skilled in the art would recognize that ovens are not mentioned because in fact Nashawaty's system is not usable for an oven. It is activated only by movement of the plunger or the slight resilience of a burner, but an oven cannot be filled with plungers or burners to enable detection of an object anywhere in the oven. Further, Nashawaty teaches the use of magnets to open and close the circuits, but magnets placed inside an oven would soon be demagnetized by the heat.

U.S. Pat. No. 3,990,074, to Sondy, describes an alarm to notify a kiln operator that the preset time and temperature have been reached and that the firing has been completed. It does not describe an operation that requires a preheating step in the operation of a kiln.

U.S. Pat. No. 4,727,799, to Oshima, describes a sensor for detecting the surface temperature of food being cooked and does not mention an alarm system nor is one required.

The following patents do not fall within the commonly accepted definition of an oven:

Paul describes a hot food stand in U.S. Pat. No. 4,733,054 that describes heat lamps to keep food warm, which is not the same function described in this application.

Frisk, in U.S. Pat. No. 2,147,024 provides for a bread raising cabinet that maintains a constant predetermined temperature while dough within it is rising and also, that no heat will be produced when no dough is in the cabinet. The claimed alarm is a buzzer that is actuated when the dough has risen to a predetermined elevation. There is no provision for increasing the heat of said cabinet above bread raising temperatures, which are not high enough to cause much damage to contents.

U.S Pat. No. 2,142,599, to Binder, describes a heated receptacle designed to prevent freezing of milk left outside during freezing weather.

The use of a weight-activated warning light in kitchen stoves has been described in U.S. Pat. No. 2,879,708 to Cripe, which relates to an automatic grease saver for stove top griddles and indicates when the grease container is full.

U.S. Pat. No. 3,330,203, to Korr, describes a food heating apparatus that passes an electric current directly through the food to be heated, requires no preheating and cannot accommodate a variety of food containers or other objects.

Consequently, it would be advantageous to have a apparatus which would detect an object within an oven, regardless of where in the oven the object is located. It would also be advantageous for the apparatus to be operable with only a single detection sensing means which would be activated no matter where in the oven the object was situated. Further, it would be advantageous for the apparatus to be such that is it operable with both gas and electric heated ovens.

SUMMARY OF THE INVENTION

The principal object of the present invention is to provide a warning apparatus for use in prevention of loss or damage from undesired or inadvertent heating of items located within the confines of an oven in a kitchen range during the preheating phase of oven operation.

It is also an object of this invention to provide a warning apparatus useful for eliminating a fire hazard in the kitchen caused by the inadvertent heating of a flammable object in the oven.

It is also an object of this invention to provide such a apparatus that is of simple and inexpensive construction and which can be used with both gas and electric ovens.

It is also an object of this invention to provide such a apparatus that is constructed of heat-resistant materials that may already be used in oven construction, so that it can operate at baking, broiling or oven cleaning temperatures.

The foregoing objects can be accomplished by this invention, which in its broadest form, comprises an apparatus to sense the presence of an object at any location within an oven and to provide a warning of such presence to a user of the oven. The apparatus includes an oven having an internal heatable chamber, controllable heating elements to heat the chamber, at least one food support rack within the chamber, and rack supports disposed on the sides of the chamber to support the rack; a pivot attached to the underside of the rack to contact the rack support, the pivot being adapted to allow the rack to rock slightly about its horizontal plane in response to the presence or absence of an object resting on the rack; alarm activation means operably associated with said rack and adapted to be activated when said rack rocks on said pivot means in response to the presence of an object in said chamber; and an audible or visible alarm thereby activated to provide an observable alarm to the user of the oven of the presence of the object within the oven.

In preferred embodiments, the alarm activation means will be an electrical switch, which when closed completes an electrical circuit with the alarm and thereby causes the alarm to be activated. The alarm may produce a visible or audible signal to the user. The apparatus may be mounted within the oven, in a recess formed in the oven wall or it may be separately attached to the outside of the wall. The oven may be gas- or electrically-heated. Closure of the switch may be directly by contact with the rack as the rack moves in response to the presence of the object in the oven, or it may be by indirect means, such as an optical device which moves with the rack and when there is an object on the rack directing a light beam onto a photoelectric cell which generates a signal which causes the switch to close and activate the alarm.

DETAILED DESCRIPTION AND PREFERRED EMBODIMENTS

Figure 1:
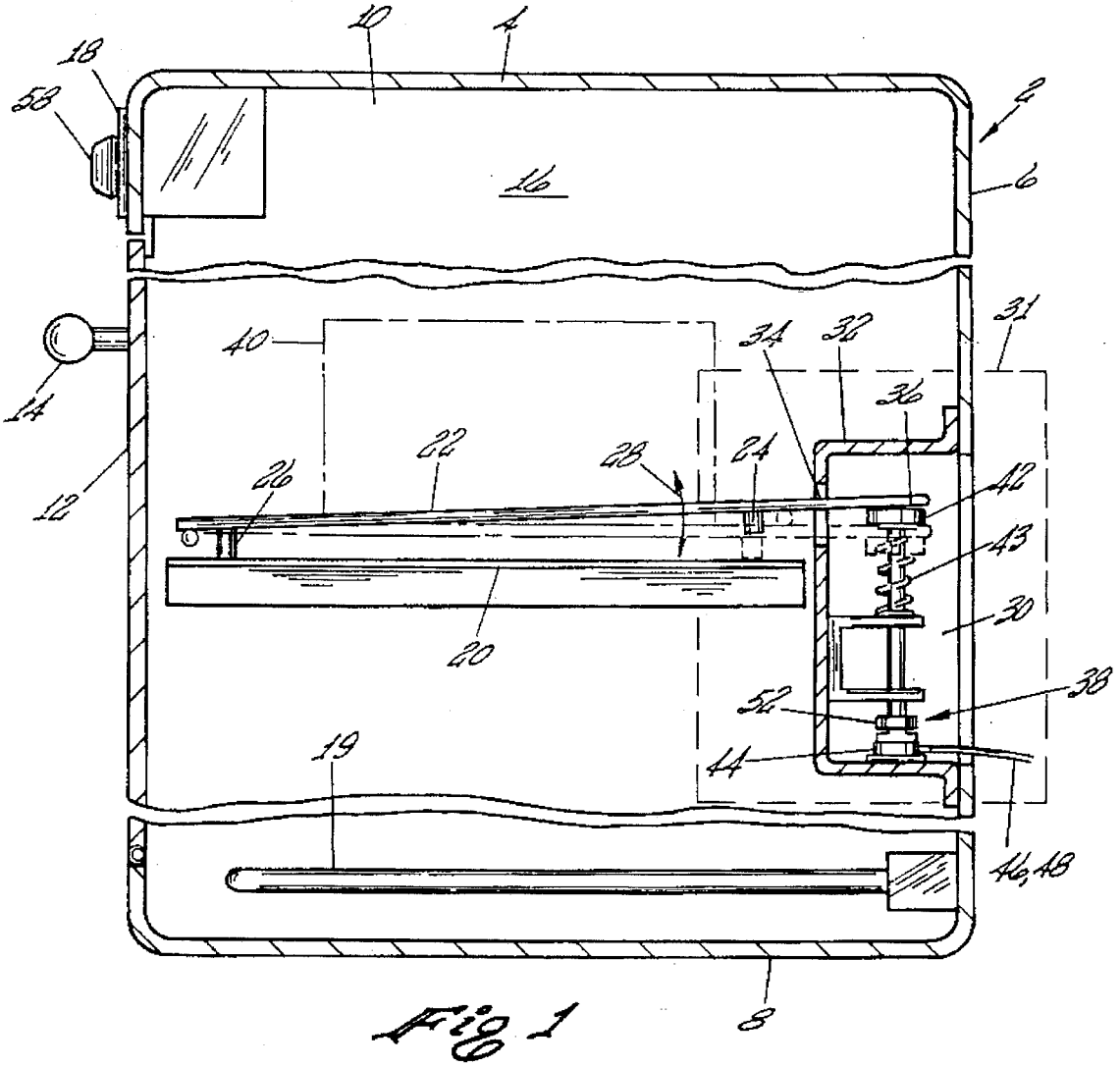
FIG. 1 is a schematic cross sectional side elevation view of an oven in which an embodiment of the apparatus of this invention is installed.

The apparatus of this invention is best understood by reference to the drawings. FIG. 1 schematically in cross section illustrates an oven generally indicated as 2 which has a top 4, a rear side or wall 6, a bottom 8 and two lateral sides 10 (only one of which is shown in the sectioned drawing). Typically the oven 2 also has a hinged door 12 with an external handle 14 to permit the user's access to the interior of the chamber 16 within the oven. A control panel 18 is commonly mounted on the front of the oven, from which at least one heating element 19 is controlled. In this embodiment the heating element 19 is shown as an electric element, but a gas burner could also be used.

The broiler burners or elements have been omitted for the sake of simplicity.

Within the chamber 16 and attached to the lateral sides 10 are one or more pairs of support shoulders 20 which are conventionally used to support one or more food support racks 22. Conventionally each such rack 22 rests directly on the support shoulders 20 and is not free to move vertically or rotate with respect to the shoulders. In the present invention, each support rack 22 is modified by the attachment of a pivot projection or "button" 26. Optionally one can also incorporate support projections 24. Each of the projections 24 and 26 is positioned directly over a shoulder 20, so that the rack 22 does not rest directly on the shoulders 20 but rather is elevated slightly by means of the projections 24 and 26.

Figure 3:
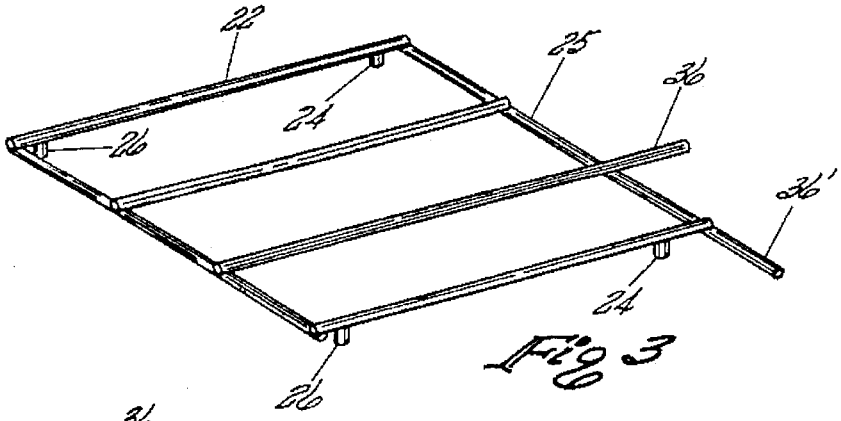
FIG. 3 is a perspective view of a typical oven rack of this invention, showing alternative positions of a triggering portion of the rack.

Because of pivot projections 26, the rack 22 when placed on shoulders 20 will be able to pivot or rock slightly as indicated by the arrow 28. (If projections 24 are used, projection 26 must be longer than the projections 24 to permit the rocking.) Projections 24 are at or near the rear end of the rack 22 as indicated in FIG. 3, to limit the rocking or pivoting that the rack is permitted. Pivot projections 26 will be near but not at the door end of the rack 22, resulting in an excess of weight of the rack 22 at the end facing the back of the oven.

In one embodiment of the invention, there is incorporated into the lateral side or the back of the oven (here exemplified by the back 6) a recess 30 which is formed by an indentation 32 in the respective wall or back. The indented portion 32 has an aperture or opening 34 therein aligned with the end or side of the rack 22. Attached to rack 22 is a projection 36 which is adapted to project through opening 34 into chamber 30. If the chamber 30 is on the back 6 of the oven, the projection will be at the end 25 as shown in FIG. 3 at 36. If the recess 30 is in one of the lateral sides 10 of the oven the projection will be at the side of the rack, as indicated in phantom lines and designated 36'.

Within the recess 30 is the alarm activator, generally outlined by the box 31, by which in the preferred embodiment illustrated is an electrical switch mechanism 38 which is activated when the rack 22 is depressed into the recess 30 in response to having an object (generally designated 40) placed at any location thereon. In the embodiment shown in FIGS. 1 and 2, the switching mechanism is a normally OFF or open electrical switch. A plunger 42 is held by compression spring 43 above a contact plate 44 on which there are two contacts 45 leading respectively to wires 46 and 48. Compression spring 43 is sized to be balanced closely with the excess weight of rack 22, so that when the rack is unoccupied the spring 43 is not depressed and the electrical contact is not closed. However, when the rack 22 has an object 40 placed thereon, the weight of that object 40 of course adds to the excess rack weight already present, and causes the rack to rock further downward as indicated by arrow 50. Plunger 42 in turn is depressed against spring 43, the resistance of spring 43 is exceeded and a metal portion 52 at the bottom of plunger 42 closes the contacts 45 and closes the circuit formed by wires 46 and 48. Also incorporated in this circuit is an observable signal here indicated by light bulb 54 which, when the circuit is closed, draws power from a conventional power source 57 (not shown) and is illuminated. When the object 40 is removed from the rack 22, the compression spring 43 resiles and forces the plunger 42 upward disconnecting it from contacts 45 and breaking the electrical circuit extinguishing bulb 54.

Figure 6:
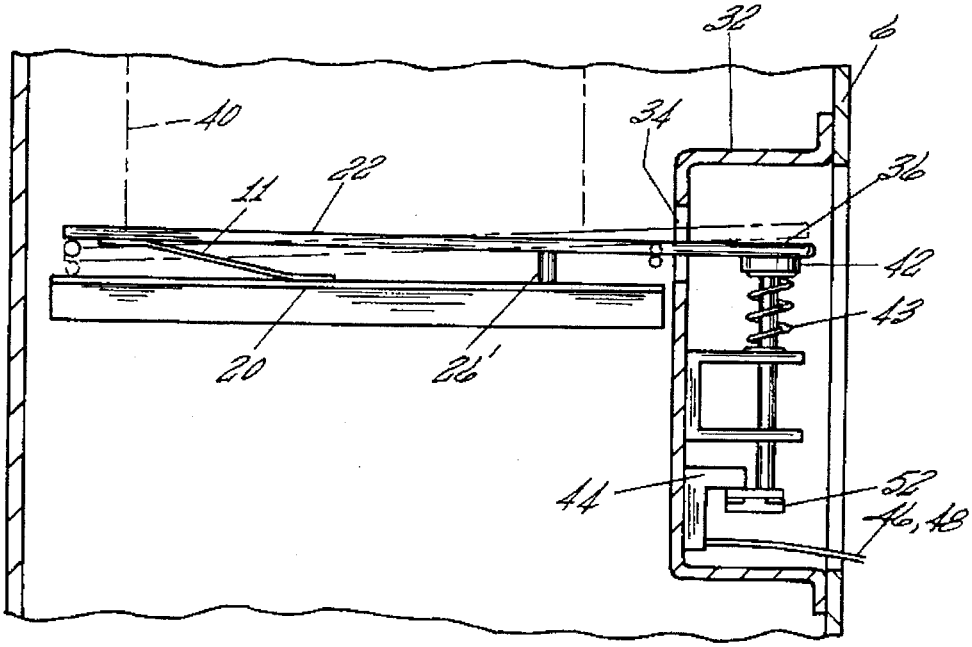
FIG. 6 is another view of that portion of FIG. 1 outlined by dashed lines, and illustrates the apparatus of the present invention in an alternative configuration to that of FIG. 2 where there is an object in the oven.
Figure 7:
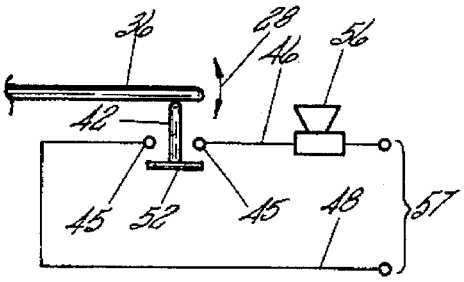
FIG. 7 is a schematic diagram of a warning circuit for use with the embodiment of FIG. 6, also illustrating use of an audible alarm.

As indicated in FIGS. 6 and 7, the circuitry can also be designed with another form of a normally OFF or open switch with the rack pivoted downward by leaf spring 11. In this case, there is little resistance in spring 43, such that it is fully compressed by the rack, and the plunger 42 is at its lowest position. The projection 26 is placed closer to the back 6 of the oven, so that when an object 40 is placed on the rack 22, leaf spring 11 is compressed and rack 22 and projection 36 are pivoted upward and the compression spring 43 resiles, urging the plunger 42 upward and causing the normally open switch to be closed by having the metal contact 52 close the gap across contacts 45.

Figure 8:
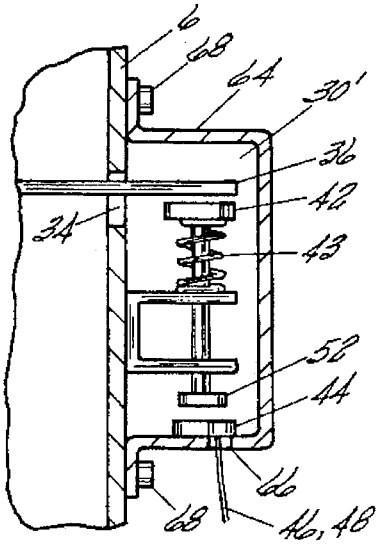
FIG. 8 is another view of that portion of FIG. 1 outlined by dashed lines, and illustrates an alternative form in which the switch portion of the apparatus is separately mounted on the outside wall of the oven rather than being disposed in a wall recess.

Yet another embodiment is shown in FIG. 8, in which the switch and associated components are housed not in a recess 30 formed in the oven wall 6, but rather in a space 30' which is formed within a box-like casing 64 which is attached to the outside of the wall 6 as by bolts 68. Opening 34 still provides access to space 30' as it did to recess 30. The electrical wires 46 and 48 reach plate 44 through access hole 66 in casing 64. This embodiment is particularly useful when one wishes to retrofit an existing oven which does not have a recess 30 previously formed in its walls.

Figure 10:
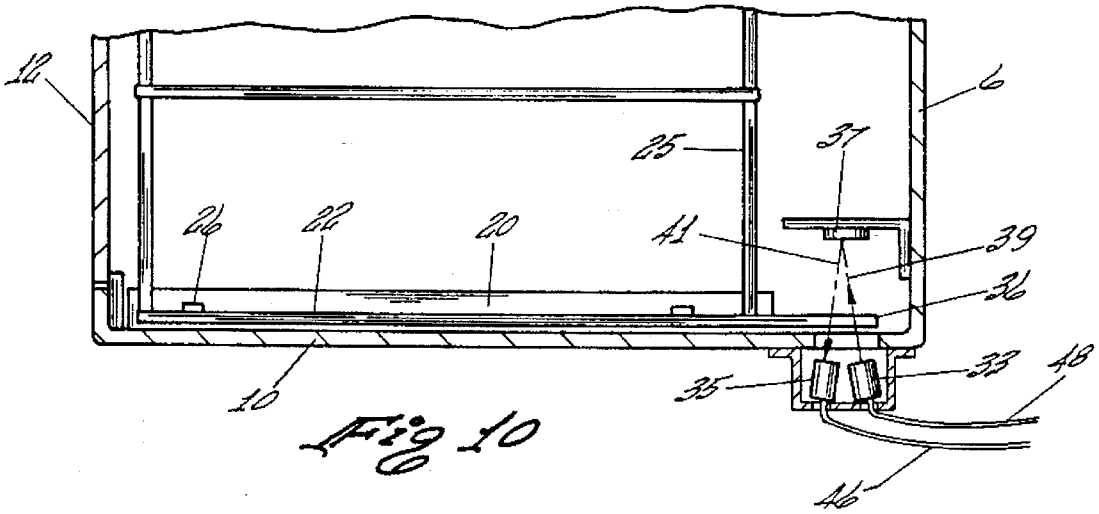
FIG. 10 is a top view of a portion of the apparatus illustrating an alternate embodiment in which the alarm activation system operates by use of a light beam to activate a photoelectric cell, which in turn causes the alarm to be activated.

Other forms of alarm activation means 31 will be evident to those skilled in the art, and the present invention is intended to encompass these. For instance, in FIG. 10 the alarm circuitry includes a small directional light source 33 and a photoelectric cell 35 which generate a signal through lines 46 and 48 to close a normally open switch (not shown) when a light beam 39 travels between them. A small mirror or prism 37 is positioned to reflect the light beam 39 along a path 41 into which projection 36 extends when the rack 22 has no object 40 on it, so that path 41 is interrupted and light beam 39 cannot pass between source 33 and cell 35. When the rack 22 is rocked in response to the presence of the object 40, the projection 36 is moved out of the light path 41 and light beam 39 from directional light source 33 then impinges on the active face of cell 35. The signal generated in response thereto as noted is transmitted through lines 46 and 48 to a switch which thereupon closes and activates the alarm. The light source 33 mirror or prism 37 and cell 35 may all be within the oven or in an external recess (as shown in FIG. 10). It will normally be preferred to have the light-based system of FIG. 10 outside the oven since many photocells are adversely affected by high temperatures and food vapors can coat the light source 33 and/or prism or mirror 37 to reduce their efficiency. However, where temperature resistance photocells are used and the mirror or prism and light source kept clean, an internal system will be entirely suitable.

Figure 5:
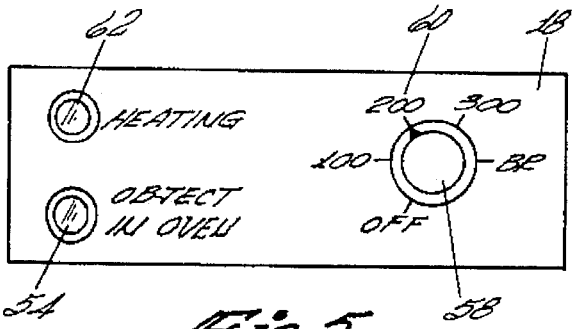
FIG. 5 is a front elevation view of a typical oven control panel illustrating the presence of a warning light.

The alarm itself may be in the control panel of the oven, as illustrated in FIG. 5 or it could be separate from the oven altogether. The latter arrangement would be advantageous, for instance where it was intended to retrofit an existing oven and incorporation of the alarm into the control panel or other structure of the oven was difficult or not feasible.

Figure 2:
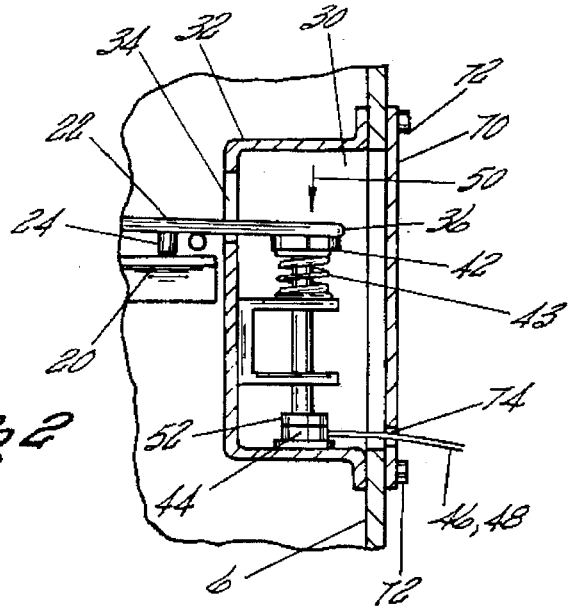
FIG. 2 is a schematic view of that portion of FIG. 1 outlined by dashed lines, and illustrates the apparatus of this invention in a configuration where there is an object occupying the oven.

For protection of the components, appearance or for safety purposes, it may be desirable to cover recess 30 with a removable cover plate, illustrated as 70 in FIG. 2, which can be held in place in any convenient manner, as by bolts 72. An access hole 74 is provided for electrical wires 46 and 48.

Figure 9:
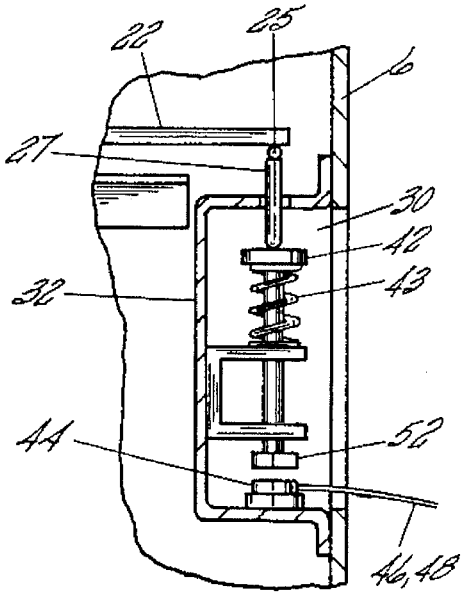
FIG. 9 shows another alternative to the structure shown in FIG. 2.

FIG. 9 illustrates an embodiment in which projection 27 replaces projection 36 and projects downwardly from the rear cross bar 25 or rack 22. As the rack pivots projection 27 activates or releases the switch mechanism.

In the embodiments thus described, the pivot projection 26 is shown made of a rigid material such as metal or ceramic. Alternatively, but less preferred, one may make the projection 26 out of a resilient material, such as a metallic compression spring. As such, the fulcrum for pivoting rack 22 is nearest the oven door, and the weight of the object 40 compresses the resilient projection 26 (as indicated at 26' in FIG. 6).

A typical control panel 18 is shown in FIG. 5. The control panel normally contains at least an oven temperature control 58 which incorporates an OFF position and can be turned to regulate the desired temperature setting of the oven as indicated by the temperature scale 60 incorporated into the panel 18. Commonly the oven panel also contains a light 62 which indicates that the oven is heating to the desired temperature. The light 62 is responsive to a thermostatic switch (not shown) which, upon reaching the preset temperature, extinguishes the light 62. That thermostatic circuitry also maintains the temperature by alternately turning on and off the heating elements 19 so that the desired internal temperature is maintained.

Figure 4:
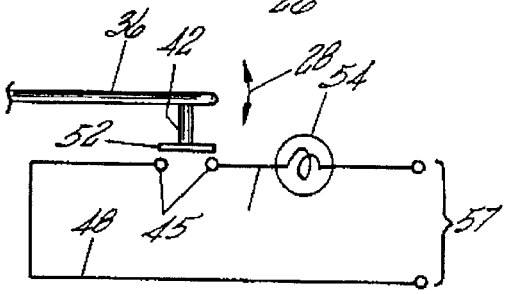
FIG. 4 is a schematic diagram of a typical warning light circuit for this apparatus.

In the embodiment shown in FIGS. 4 and 5, the weight warning is displayed in the form of a light bulb, indicated in FIG. 5 as being red to contrast with a green heating light. Of course, any color or combination of colors can be used which will give adequate warning to the user. Alternatively, the light 54 could be replaced by an audible signal in the form of a buzzer or an audio speaker 56 shown in FIG. 7, which is activated when a weight is placed on the oven rack 22. Such an audio signal is less preferred, however, since the signal remains on while the weight 40 remains on the rack. While a warning light can remain on and be unobtrusive to persons in the vicinity of the oven, the continuous sounding of an audible signal is likely to be annoying. With additional conventional circuitry incorporated, however, an audible signal may be interrupted and made intermittent, so that it sounds only at periodic intervals to remind the user that the object is still in the oven.

I claim:

1. Apparatus to sense the presence of an object within an oven and to provide a warning of such presence to a user of the oven, comprising:

an oven having lateral, rear, top and bottom walls forming an internal heating chamber for containing and heating foods, heating means for heating said chamber, a rack having a main portion on which food is placed, and support means for supporting said rack on the lateral walls of the chamber so that the main portion is in a substantially horizontal food supporting position elevated above said bottom wall;

pivot means attached to the rack for contacting said support means and allowing said main portion of the rack to rock slightly about a horizontal axis in response to the presence of an object resting on the main portion;

alarm activation means operably associated with the rack and adapted to be activated when the rack rocks on said pivot means in response to the presence of an object on the rack; and alarm means activated by said activation means to provide a signal to the user of said oven of the presence of an object on the rack, one of said walls providing a recess therein opening into the chamber, said rack having an activating portion projecting into the recess, said activation means including a mechanically operated electric switch means adjacent to the rack such that when the rack is rocked in response to the presence of an object thereon, said activating portion of the rack moves in the recess in operable relationship with the switch means and causes the switch means to complete an electric circuit which activates said alarm means.

2. Apparatus as in claim 1 wherein the oven includes a housing enclosing said recess and having an opening between the recess and the chamber, the alarm activation means being disposed within the housing, said activating portion of the rack extending through the opening into the recess to contact the alarm activation means.

3. Apparatus as in claim 2 wherein the opening is in a lateral wall of said oven.

4. Apparatus as in claim 2 wherein the opening is in the rear wall of said oven.

5. Apparatus as in claim 1 wherein limit means are positioned between said rack and the rack support means to limit the amount the main portion of the rack can rock about said horizontal axis.

6. The combination of an oven used for cooking food and an apparatus for sensing the presence of an object within the oven and to provide a warning of such presence to a user thereof, said oven providing an internal heating chamber, an oven door having open and closed positions, a rack for supporting food or other objects in the chamber, means for mounting the rack in the chamber, means for heating the chamber in order to cook food supported on the rack, and user control means operable exteriorly of the oven when the door is in closed position for controlling the heating means to regulate the desired temperature in the chamber and for enabling the chamber to be pre-heated while the door is in closed position and without opening the same and irrespective of whether an object is in the chamber;

said apparatus including an object warning device having a signaling mode for signaling to a user exteriorly of the oven the presence of an object in the chamber, and means responsive to the presence of an object on the rack for placing the warning device in its signaling mode so that a user of the oven can determine if an object is in the oven and thereby avoid heating an object that is not intended to be heated.

7. The combination of claim 6 wherein the oven has side walls on opposite sides of the chamber, wherein the mounting means mounts the rack for manual sliding movement along said side walls into and out of the chamber when the door is open while at least partially supporting the rack during such movement, said mounting means also mounting the rack for limited rocking movement about a substantially horizontal axis when the rack is in the chamber, said responsive means being responsive to rocking movement of the rack for placing the object warning device in its signaling mode.

8. The combination of claim 6 wherein the chamber has opposite sides, wherein said mounting means includes generally horizontal supports facing inwardly from the sides of the chamber, wherein said mounting means releasably mounts the rack on the supports for limited rocking movement about a generally horizontal axis when an object is placed on the rack, and wherein said responsive means places the warning device in its signaling mode in response to said rocking of the rack.

9. The combination of claim 6 wherein the oven has side walls on opposite sides of the chamber, wherein the mounting means includes substantially horizontal supports disposed on the side walls, and wherein the mounting means also includes fulcrum members on the rack in sliding and rocking engagement with the supports for enabling sliding of the rack on the supports into and out of the chamber and for enabling rocking of the rack on the supports when an object rests on the rack in the chamber, said responsive means being responsive to said rocking of the rack to place said warning device in its signaling mode.

10. The combination of claim 6 wherein the rack is an assembly of elongated rods interconnected in an open grill configuration, wherein said responsive means includes an activating member projecting from one of said rods, and wherein, except for said activating member, the remainder of the responsive means is mounted on the oven in a position to interact with the activating member when an object is on the rack thereby to cause the warning device to go into its signaling mode.

11. The combination of claim 6 wherein the rack is an assembly of substantially parallel elongated longitudinal and transverse rack members, wherein the oven has side walls on opposite sides of the chamber, wherein the mounting means includes substantially horizontal supports disposed on the side walls and fulcrums respectively positioned between said supports and said longitudinal rack members thereby to allow rocking movement of the rack when an object is placed on the rack, wherein said responsive means includes an elongated activating member projecting from one of said rack members, and wherein said responsive means also includes an activator means responsive to the positioning of the activating member when an object is on the rack thereby to cause said warning device to be placed in its signaling mode.

12. The combination of claim 6 wherein the responsive means includes photoelectric means.

13. The combination of an oven for cooking food having a door and a heating chamber which is normally preheated without opening the door in order to bring the temperature of the chamber up to a desired temperature before opening the door and before placing food-to-be-cooked in the chamber, and an apparatus for detecting the presence of food or other objects in the chamber, comprising an object warning device associated with the oven for indicating exteriorly of the oven the presence of an object in the chamber when the oven door is closed;

said oven also including a rack for supporting food or other objects thereon, means for supporting the rack in the chamber and for permitting movement of the rack inwardly and outwardly of the chamber when the door is open thereby to support food or other objects in the chamber and to enable food or other objects to be moved inwardly and outwardly of the chamber on the rack, means for heating the chamber in order to cook food on the rack, and control means for controlling the heating means when the door is closed to regulate the desired temperature in the chamber irrespective of whether food or another object is in the chamber and to preheat the chamber without opening the door and before food-to-be-cooked is placed in the chamber; and sensing means responsive to the presence of an object on the rack when the rack is in the chamber and causing the warning device to indicate such presence, said sensing means permitting said movement of the rack inwardly and outwardly of the chamber, and said sensing means including means for activating the warning device independently of the operation of the heating means by the control means so that when the door is closed the warning device indicates the presence of an object in the chamber irrespective of the operation of the heating means by the control means.

14. The combination of claim 13 wherein said door is a front door of the chamber, wherein the chamber has a back wall and opposite side walls, wherein the supporting means includes shoulders on the side walls which extend therealong forwardly and rearwardly of the chamber, said supporting means supporting the rack on the shoulders for said inward and outward movement therealong, said activating means including an activator on the rack and a sensor on a wall of the chamber, said rack moving away from and toward the sensor during said outward and inward movement respectively, said activator being interactive with the sensor but not physically connected thereto whereby said sensor is activated by the activator when an object is on the rack but permits said inward and outward movement of the rack on the shoulders.

15. The combination of claim 14 wherein the activator is a projection extending from the rack which moves therewith between an operative position for interacting with the sensor when the rack is completely in the chamber and an inoperative position incapable of interacting with the sensor when the rack is moved outwardly of the chamber.

* * * * *